US005081854A

United States Patent [19]

Lonati

[11] Patent Number: 5,081,854

[45] Date of Patent: Jan. 21, 1992

[54] PROCESS FOR MANUFACTURING A SEMI-FINISHED PRODUCT WITH CIRCULAR KNITTING MACHINES, IN PARTICULAR FOR PRODUCING UNDERSHIRTS, ONE-PIECE BODY GARMENTS, BRIEFS OR THE LIKE

[75] Inventor: Francesco Lonati, Brescia, Italy

[73] Assignee: Lonati S.p.A., Brescia, Italy

[21] Appl. No.: 489,129

[22] Filed: Mar. 5, 1990

[30] Foreign Application Priority Data

Mar. 16, 1989 [IT] Italy ..... 19791 A/89

[51] Int. Cl.[5] ..... A41B 9/04; A41B 9/06; D04B 1/24

[52] U.S. Cl. ..... 66/176; 2/402

[58] Field of Search ..... 66/172 R, 176, 177, 66/175, 182

[56] References Cited

U.S. PATENT DOCUMENTS

| | | | |
|---|---|---|---|
| 1,237,473 | 8/1917 | Chipman | 66/172 R |
| 3,985,003 | 10/1976 | Reed | 66/177 X |
| 4,010,627 | 3/1977 | Pernick | 66/177 |
| 4,043,156 | 8/1977 | Pernick | 66/177 |
| 4,627,115 | 11/1986 | Safrit et al. | 66/172 R |
| 4,682,479 | 7/1987 | Pernick | 66/176 |
| 4,887,439 | 12/1989 | Temconi | 66/176 X |

FOREIGN PATENT DOCUMENTS

| | | | |
|---|---|---|---|
| 1234471 | 5/1986 | U.S.S.R. | 66/172 R |

*Primary Examiner*—Werner H. Schroeder
*Assistant Examiner*—John J. Calvert
*Attorney, Agent, or Firm*—Guido Modiano; Albert Josif

[57] ABSTRACT

The process consists in producing a body of knitting having a substantially tubular extension, with portions which are to be removed and a remaining part. The remaining part is knitted with a plurality of threads. The portions which are to be removed are knitted with fewer threads than the remaining part.

20 Claims, 2 Drawing Sheets

PROCESS FOR MANUFACTURING A SEMI-FINISHED PRODUCT WITH CIRCULAR KNITTING MACHINES, IN PARTICULAR FOR PRODUCING UNDERSHIRTS, ONE-PIECE BODY GARMENTS, BRIEFS OR THE LIKE

BACKGROUND OF THE INVENTION

The present invention relates to a process for manufacturing a semi-finished product with circular knitting machines, in particular for producing undershirts, one-piece body garments, briefs or the like.

As known, tubular knitted products manufactured with circular knitting machines are used to produce undershirts with no lateral seams. Said products have a substantially uniform knitting along their entire extension, except for any possible ornamental patterns, and in order to produce undershirts they are first cut according to the required length, and four portions are subsequently removed at a longitudinal end of the product so as to respectively define the front and back neck-openings and the openings for the arms. When these four portions are removed, four flaps are defined and are subsequently sewn together in pairs so as to obtain the shoulders of the undershirt.

A finishing border is applied along the cutting lines for the removal of the four portions, and the lower end of the undershirt is subjected to a hemming operation with the possible application of an elastic strip.

With this process, the waste consequent to the removal of the portions corresponding to the neck and arm openings considerably affect production costs, since the thread used for this kind of product is generally of high quality.

The cutting operations furthermore generally require the use of templates in order to obtain sufficiently precise results, and imply relatively long times and in turn affect production costs.

Semi-finished products for producing briefs are also known which are also manufactured with particular circular machines which are similar to circular knitting machines for manufacturing socks and stockings, but with an enlarged needle cylinder.

A first kind of product is manufactured by means of a process which substantially consists in initially providing an elastic hem and, after said hem, a section of tubular knitting, using nearly all the needles of the needle cylinder. In a subsequent step, an increasing number of needles belonging to two sets of needles are excluded from knitting; said sets of needles are angularly mutually spaced with respect to the axis of the needle cylinder so as to define, on the lateral surface of the product, two missing portions which correspond to the leg opening of the briefs to be produced. The number of needles excluded from knitting gradually increases up to a maximum value to obtain a widening of the leg openings and to obtain such a length of the portions between the two missing portions as to allow their overlapping and sewing to obtain the crotch of the briefs. The thread or threads are cut, at the beginning of the sets of needles which are not knitting, i.e. at the edges of the leg openings, by means of appropriate devices fitted to the circular knitting machine being used.

The product is finished by applying an elastic tape or lace to the edge which delimits the leg openings and by sewing the overlapping ends of the portions of knitting arranged between the two missing portions so as to provide, as mentioned, the crotch of the briefs.

However, this known type of product is not devoid of disadvantages, not least of which is the fact that flaws or ladders often form at the leg openings and propagate along the knitted fabric. Such flaws most frequently occur during the final stages of manufacturing the product i.e., when subjecting the product to pneumatic tensioning, during expulsion of the product from the knitting machine, or when applying elastic tape to the edges of the leg openings. Obviously, the presence of such flaws results in the product being rejected.

A second kind of product is manufactured with a process which instead of cutting the threads at the edge of the leg openings obtains a complete tubular product, and two portions knitted with different stitches with respect to those used for the remaining part of the product are provided at the leg openings, or stitches are knitted along lines corresponding to the border of the leg openings, so as to allow the easy identification of the portions to be successively cut in order to provide the leg openings.

Knitting with different stitches of the entire portions to be removed or the delimiting thereof by means of a line knitted with different stitches with respect to the remaining part of the product allows greater precision and speed in the product finishing operations.

This process safely excludes the possibility of broken meshes, flaws or ladders before the finishing oeprations, but has the disadvantage of requiring considerable waste for each product.

SUMMARY OF THE INVENTION

The aim of the present invention is to obviate the above described disadvantages by providing a process for manufacturing semi-finished products usable for producing undershirts, one-piece body garments, briefs or the like, which avoids the occurrence of broken meshes, flaws or ladders in the product during its manufacture and reduces manufacturing costs by reducing losses due to waste.

Within the scope of this aim, an object of the invention is to provide a process by means of which the finishing operations are rendered extremely simple and rapid.

Another object of the invention is to provide a process which allows to obtain high-quality products.

The above mentioned aim and objects are achieved by a process for manufacturing a semi-finished product according to the present invention. The process envisages the manufacture of a body of knitting on a circular knitting machine. The body of knitting has a substantially tubular extension, with portions which are to be removed and a remaining part. The remaining part is knitted with a plurality of threads. The portions which are to be removed are knitted with fewer threads than the remaining part.

BRIEF DESCRIPTION OF THE DRAWINGS

Further characteristics and advantages of the invention will become apparent from the description of some preferred but not exculsive embodiments of the process according to the invention, illustrated only by way of non-limitative example in the accompanying drawings, wherein.

DESCRIPTION OF THE PREFERRED EMBODIMENTS

With reference to the above described figures, the process according to the invention substantially consists in producing, with a circular knitting machine, a body of knitting having a tubular extension of the required length and in knitting the portions of the product which are to be removed by knitting stitches obtained with a number of threads of yarns which is less than the number of threads or yarns used to knit the stitches which constitute the remaining part of the product.

Said remaining part of the product is conveniently knitted by using at least two threads for each stitch, whereas the portions to be removed are knitted by using a single thread, preferably the lowest-cost thread among those used for the remaining part of the product, for each stitch. The threads which are not used to knit the portions of the product to be removed are cut by the machine at the beginning of the portions to be removed.

Stitches which are optically distinguishable from the contiguous stitches are advantageously knitted in regions of the product which are proximate to the portions to be removed, so as to define a guiding line for the subsequent product finishing operations, as will become apparent hereinafter.

Figure 1:
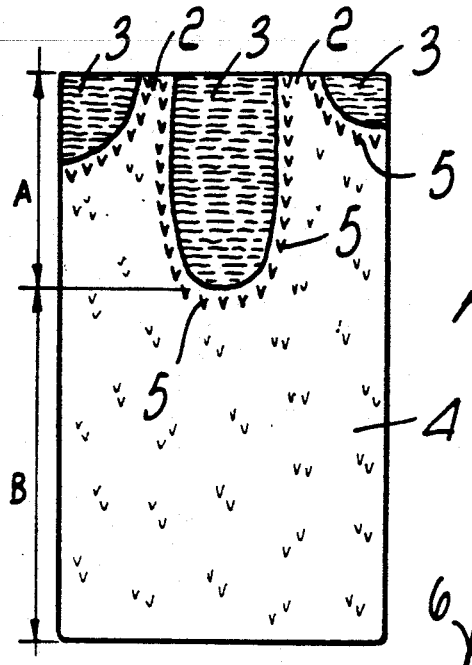
FIG. 1 is a lateral elevation view of a product for manufacturing undershirts, manufactured with a first embodiment of the process according to the invention.

More particularly, with particular reference to FIG. 1, the process according to the invention comprises, for manufacturing a product 1 according to a first embodiment, a first step A during which a first substantially tubular section of knitting is produced, composed of four first portions 2 angularly spaced with respect to one another relative to the axis of the product and alternated with four second portions 3 intended to be removed. In order to manufacture said first section of knitting, the needles of the needle cylinder are divided by selection into four first sets intended to knit the first portions 2, alternated with four second sets of needles intended to knit the second portions 3.

If it is required for example to knit the first portions with two threads and the second portions with a single thread, it is possible to proceed as follows.

Figure 9:
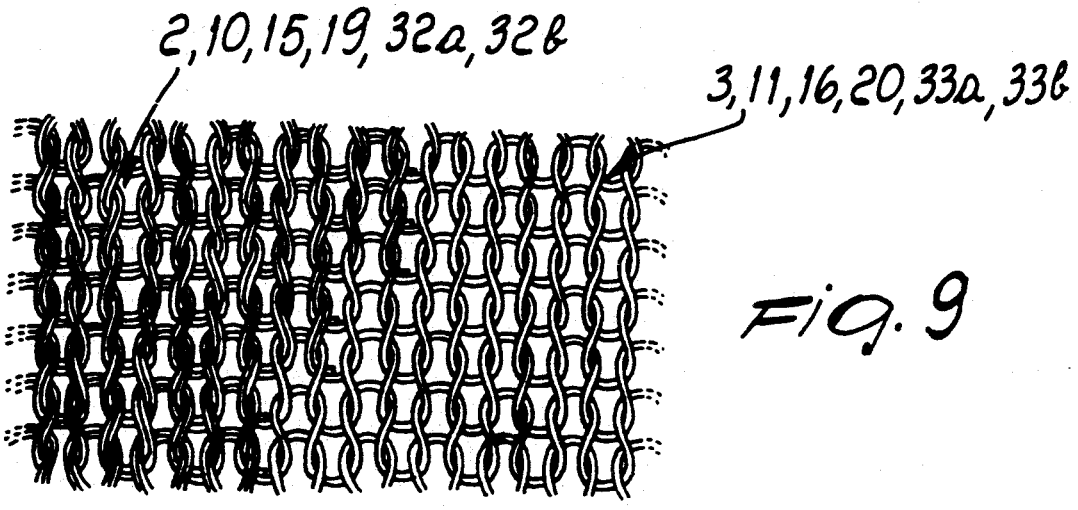
FIG. 9 is a view of an enlarged portion of the various products illustrated in the preceding figures in the region of a portion to be removed which confines with the remaining part of the product.

Each machine feed is equipped with two thread guides, one for each thread to be delivered, with delivery points located at mutually different elevations. The first sets of needles are raised upstream of the feed by means of known cams to such an elevation as to engage, with their tip, both of the delivered threads, whereas the needles of the second sets are raised, again in a known manner with other cams, to a lower elevation so as to enage only the thread which is delivered at the lower level. In this manner, the thread delivered by the thread guide which is arranged above remains engaged on the last needle of the first sets and remains floating behind the tip of the needles of the second sets. Said floating thread is cut by known devices which are fitted to the machine proximate to the beginning of the second portions 3, as illustrated in FIG. 9.

Thus, when the first portions are knitted with two threads and the second portions are knitted with only a single thread, one achieves a 50% saving in the quantity of thread used to manufacture the second portions. Interms of cost, the saving is even greater, since if one takes into account the fact that two threads, one of which is considerably more expensive than the other, are generally used to knit the first portions, the second portions 3 are knitted with the lower-cost thread of the two.

During said first step A it is possible to select the needles, by means of selection devices commonly used in circular knitting machines for manufacturing socks and stockings, so as to increase the needles of the first sets by subtracting them from the needles of the second sets, or vice versa, so as to obtain the desired configuration for the second and first portions. After a preset number of rows it is furthermore possible, again by means of known selection devices, to divide the needles only into two first sets and two second sets to end the second portions which correspond to the neck-openings, while the knitting of the second portions, corresponding to the arm opengings, continues.

A second step B is performed after the first step A; during said second step, a section of knitting 4 is knitted in a known manner substantially like the first portions 3.

When the product reaches the required length, knitting is ended and the product is removed from the machine.

Stitches 5, arranged proximate to the second portions 3 and easily distinguishable from the others in that they define guiding lines for the finishing operation, are knitted during the first step A and shortly after the beginning of the second step B. Said stitches can be constituted by held stitches, by stitches provided with an additional thread of a different color or by floating-thread pattern stitches which can be provided, by virtue of the fact that the product is manufactured, except for the second portions 3, by using at least two threads.

Ornamental patterns can be provided in a known manner during the knitting of the first portions and of the second section of knitting 5.

The semi-finished product can subsequently be subjected, in a simple and rapid manner, to finishing operations by means of a known machine of the cut-and-sew type, by means of which finishing borders 6 are applied, following the guiding lines defined by the stitches 5, along the neck- and arm openings. The machine simultaneously removes the second portions 3.

Figure 2:
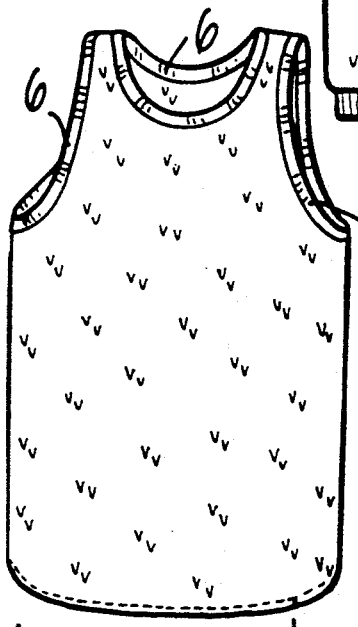
FIG. 2 is a view of an undershirt obtained with a product of the kind illustrated in FIG. 1.

The shoulders of the undershirt are then obtained by sewing together the free ends of the first portions 2 in pairs, as illustrated in FIG. 2, and a folded hem 7 is possibly provided at the lower end of the undershirt.

Figure 3:
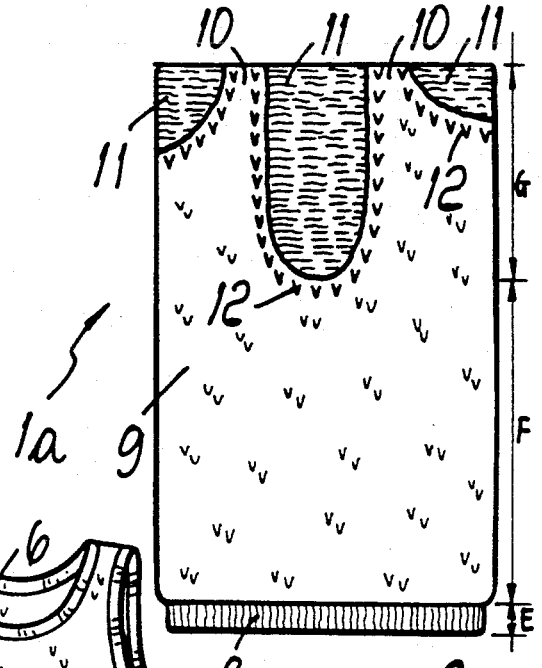
FIG. 3 is a lateral elevation view of a product for manufacturing undershirts, produced with the process according to the invention in a second embodiment.

This last operation of hemming the lower end of the undershirt can be avoided if a second embodiment of the process according to the invention is followed; said second embodiment allows to obtain a product 1*a* which is already provided with a folded hem along its lower end, as illustrated in FIG. 3.

More particularly, in this second embodiment, the knitting of the product begins from its lower end with a first step E during which the folded hem 8 with tubular extension is produced. Said hem 8 can be produced in a known manner as for the formation of the upper elastic hem of panty-hoses. If required, the hem 8 can be produced by adding an elastic thread so as to obtain an elastic folded hem.

After this first step E, a second step F is performed during which a section of knitting 9 is produced, with tubular extension starting from the elastic hem 8, and a third step G is performed during which four first portions 10 are produced as continuation of the second 9 and are alternated with four second portions 11, substantially as already described with reference to the first embodiment, taking into account the fact that in this second embodiment the product is manufactured starting from the bottom.

In this second embodiment, too, during the forming of the first portions 10 and of the section of knitting 9, proximate to the second portions 11, it is possible to produce stitches 12 formed substantially like the stitches 5 so as to define a guiding line for the successive finishing operations.

Figure 4:
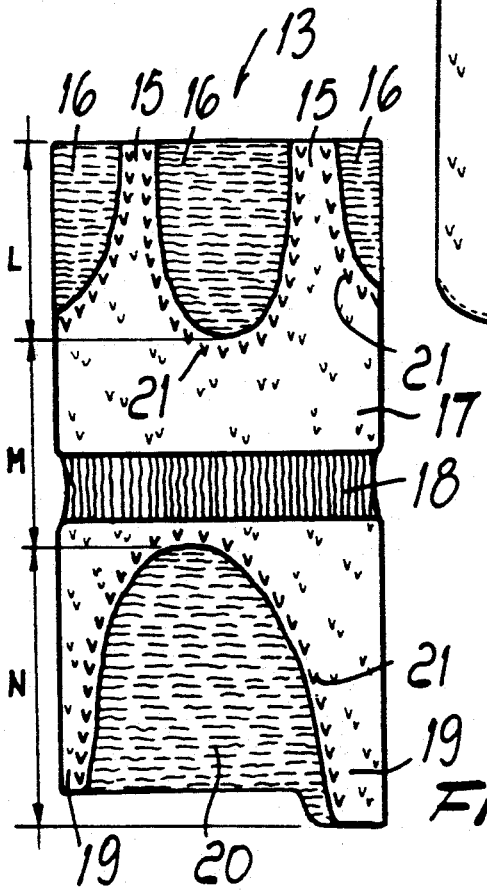
FIG. 4 is a lateral elevation view of a product for manufacturing one-piece body garments, obtained with a third embodiment of the process according to the invention.
Figure 5:
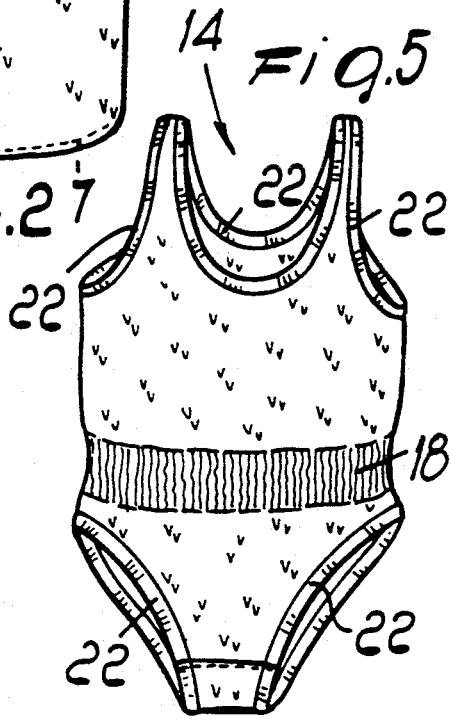
FIG. 5 is a view of a one-piece body garment obtained with a product of the kind illustrated in FIG. 4.

With a third embodiment of the process according to the invention it is also possible to manufacture a product 13 for producing one-piece body garments 14, as illustrated in FIGS. 4 and 5.

With reference in particular to FIG. 4, in this third embodiment the process comprises a first step L and a second step M which are performed substantially like the steps A and B which have already been described with reference to the first embodiment, so as to obtain four first portions 15 alternated with four second portions 16 to be removed in a first section of knitting, as well as a second section of knitting 17 with tubular extension as continuation of the first portions 15.

During the formation of the second of knitting 17, it is possible to insert, preferably in preset regions, one or more elastic threads so as to obtain for example an elastic band 18 in the region of the abdomen. This fact can be obtained by feeding the needles of the machine with an elastic thread by means of an appropriate thread guide which is activated when required.

A third step N is subsequently performed during which two third portions 19 are manufactured as continuation of the second section of knitting 17 and are alternated with two fourth portions 20 intended to be removed to define the leg openings of the one-piece body garment.

Said fourth portions 20 are manufactured substantially as already described for the manufacture of the second portions 3 in the first embodiment of the process, and said fourth portion 20 are advantageously knitted with a number of stitches which increases starting from the second section of knitting 17, subtracting from the stitches of the third portions 19, so as obtain an adequate shaping of the leg openings.

In this manner, the fourth portions 20 and the second portions 16 are manufactured using a smaller number of threads than the first portions 15 and the third portions 19, as already described for the first embodiment of the process. Stitches 21, optically distinguishable with respect to the contiguous stitches, as already described for the stitches 5, can be furthermore povided proximate to the fourth portions 20 and to the second portions 16.

When the product reaches the required length, knitting is ended in a known manner and the product is unloaded from the machine.

In this case, too, the finishing operations can be performed in a simple and rapid manner by means of a cut-and-sew machine which removes the second portions 16 and the fourth portions 20 and simultaneously applies finishing borders 22.

The upper ends of the first portions 15 are sewn together in pairs to obtain the shoulder straps of the one-piece body garment, whereas buttons or the like are applied to the free ends of the fourth portions 20 for the mutual engagment thereof.

During the knitting of the first portions 2, 10, 15 and in the sections of tubular knitting 4, 9, 17 in the various embodiments so far described it is possible to provide, in a known manner, a particular knitting termed "vanisé stitch", in which the stitches are knitted with two threads, one of which remains on the outer side of the knitting while the other remains on the inner side to obtain, if required, particular effects, such as for example if it is required to have wool thread on the outer side and cotton thread on the inner side of the product.

Figure 6:
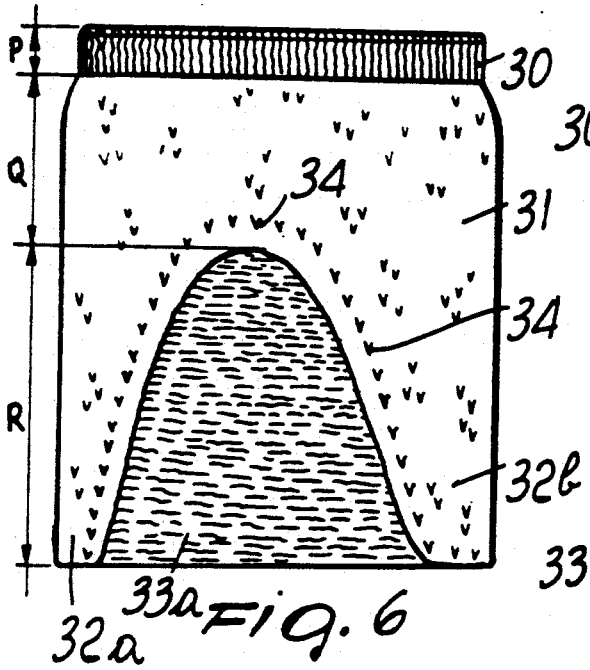
FIG. 6 is a lateral elevation view of a product for manufacturing briefs, produced with a fourth embodiment of the process according to the invention.
Figure 7:
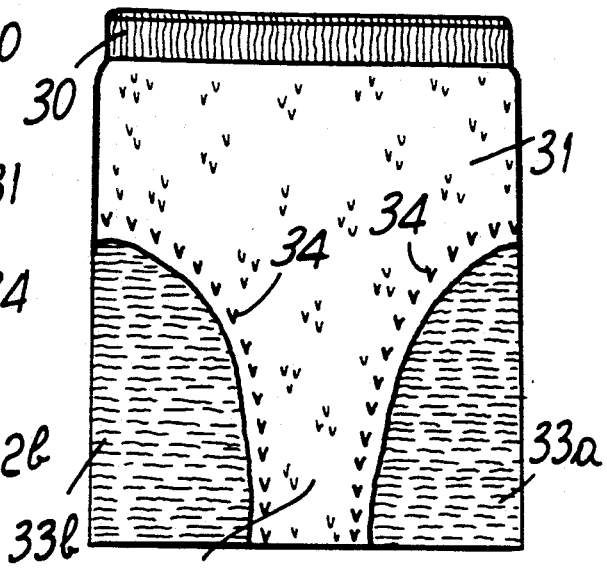
FIG. 7 is a front elevation view of the product illustrated in FIG. 6.
Figure 8:
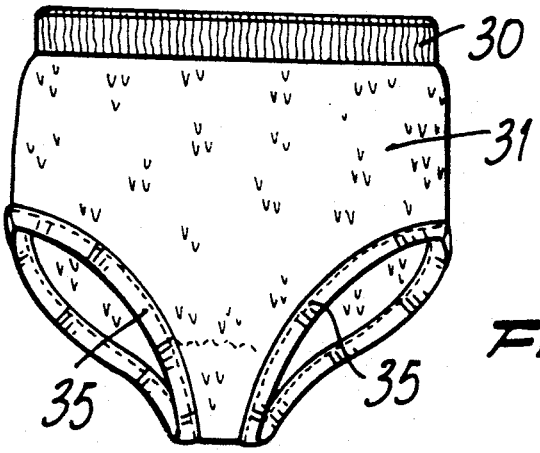
FIG. 8 is a view of a pair of briefs obtained with a product of the kind illustrated in FIGS. 6 and 7.

With a fourth embodiment of the process according to the invention, illustrated in particular in FIGS. 6 to 8, it is possible to obtain a tubular product for manufacturing briefs.

More particularly, said fourth embodiment of the process comprises a first step P in which a folded elastic hem 30 is produced, by means of the circular knitting machine, similarly to what has already been described with reference to the manufacture of the hem 8 of the second embodiment, said hem being intended to embrace the user's hips. A second step Q is subsequently performed during which the machine produces, in a known manner, a section of knitting 31 with tubular extension starting from the elastic hem 30. In a third step R, two first portions 32*a* and 32*b* are knitted as a continuation of the section of knitting 31 and are angularly spaced from one another with respect to the axis of the section of knitting 31; said portions 32*a* and 32*b* are alternated with two second portions 33*a* and 33*b* which are to be removed and are manufactured substantially like the second portions 3, like the second portions 11, like the second portions 16 and like the fourth portions 20 of the previously described embodiments, i.e. with a number of threads which is smaller than the number of threads used for the first portions 32*a* and 32*b*.

When the first portions 32*a* and 32*b* have reached the required length, the knitting of the product is ended in a known manner and the product is unloaded from the machine.

Stitches 34 which are optically distinguishable from the contiguous stitches are advantageously knitted in this fourth embodiment, too, proximate to the border of the section of tubular knitting 31 and to the first portions 32*a* and 32*b* which are contiguous to the second portions 33*a* and 33*b*, as in the previously described embodiments.

The product thus manufactured is ready to undergo the finishing operations, which substantially consist in applying a border 35 proximate to the edge of the first portions 32*a* and 32*b* by means of a cut-and-sew machine which simultaneously removes the second portions 33*a* and 33*b*. The free ends of the first portions 32*a* and 32*b* are then overlapped and sewn together, producing the crotch of the briefs, as illustrated in FIG. 8.

In practice it has been observed that the process according to the invention fully achieves the intended aim, since it allows to manufacture products which are simple and rapid to finish with considerably reduced waste costs.

The process thus conceived is susceptible to numerous modifications and variations, all of which are within the scope of the inventive concept; all the details may furthermore be replaced with technically equivalent elements.

In practice, the materials employed, as well as the dimensions, may be any according to the requirements and to the state of the art.

I claim:

1. A process for manufacturing a semi-finished product with circular knitting machines, in particular for producing undershirts, one-piece body garments, and briefs, comprising the steps of manufacturing a knitted body defining a substantially tubular extension and having;

portions which are to be removed, and a remaining body part, the improvement comprising knitting said remaining body part throughout with a first quantity of yarns, and knitting said portions which are to be removed with a second quantity of yarns, said second quantity of yarns being less than said first quantity of yarns, whereby to achieve a saving in the quantity of discarded yarn used for manufacturing the portions which are to be removed.

2. A process according to claim 1, wherein said remaining part of said knitted body is knitted using at least two yarns, and wherein said portions to be removed are knitted using a single yarn, said portions to be removed each having an edge, said at least two yarns used to knit said remaining part of the said knitted body being cut at said edge of each of said portions to be removed, whereby to achieve at least a 50% saving in the quantity of discarded yarn used for manufacturing the portions which are to be removed.

3. Improved process according to claim 1, further comprising the intermediate step of;

knitting, in regions of the product proximate to said portions to be removed, stitches which are optically distinguishable from contiguous stitches, whereby said optically distinguishable stitches define a guiding line for product finishing operations.

4. Improved process according to claim 1, wherein the steps of manufacturing a knitted body and knitting said portions which are to be removed comprise;

knitting a first section of knitting having a tubular extension defining a product axis, forming said tubular extension with four first portions defining said remaining body part, and four second portions defining said portions which are to be removed, mutually angularly spacing said first portions with respect to said product axis and alternating said first portions with said four second portions to be removed, and at least one second step of knitting a second section of knitting having a tubular extension, said second section being knitted substantially like said first portions.

5. Improved process according to claim 4, wherein after said second step, a third manufacturing step is performed including;

knitting two third portions as continuation of said second section of knitting, mutually angularly spacing said third portions with respect to said product axis, and alternating said third portions with two fourth portions to be removed in order to produce a one-piece body garment.

6. Improved process according to claim 1, comprising the intermediate manufacturing steps of;

knitting a folded hem having a tubular extension, manufacturing a section of knitting having tubular extension extending from said folded hem and defining a product axis, manufacturing four first knitting portions as a continuation of said tubular section of knitting, whereby to form therewith said knitted body, mutually angularly spacing said first knitting portions with respect to said product axis, and alternating said four first portions with four second portions consituting said portions which are to be removed.

7. Improved process according to claim 6, wherein said folded hem is produced by adding an elastic thread.

8. Improved process according to claim 1, wherein preset regions of the product are produced by adding elastic thread.

9. Improved process according to claim 1, comprising the intermediate steps of;

forming a folded elastic hem having a tubular extension, manufacturing a section of knitting having a tubular extension, extending from said folded elastic hem and defining a product axis, manufacturing two first knitting portions as continuation of said section of knitting having a tubular extension, whereby to form therewith said knitted body, mutually angularly spacing said two first portions with respect to said product axis, alternating said two first portions with two second portions constituting said portions to be removed.

10. A process for manufacturing a semi-finished product with circular knitting machines, in particular for producing undershirts, one-piece body garments, and briefs, comprising the steps of manufacturing a knitted body defining a substantially tubular extension and having;

portions which are to be removed, and a remaining body part, the improvement comprising knitting said remaining body part throughout with a first quantity of yarns, and knitting said portions which are to be removed with a second quantity of yarns, said second quantity of yarns being less than said first quantity of yarns, wherein said remaining part of said knitted body is knitted using at least two yarns, and wherein said portions intended to be removed are knitted using a single yarn, said portions to be removed each having an edge, said at least two yarns used to knit said remaining part of the said knitted body being cut at said edge of each of said portions to be removed, whereby to achieve a saving in the quantity of discarded yarn used for manufacturing the portions which are to be removed.

11. Improved process according to claim 10, further comprising the intermediate step of;

knitting, in regions of the product proximate to said portions to be removed, stitches which are optically distinguishable from contiguous stitches, whereby said optically distinguishable stitches define a guiding line for product finishing operations.

12. Improved process according to claim 10, wherein the steps of manufacturing a knitted body and knitting said portions which are to be removed comprise;

knitting a first section of knitting having a tubular extension defining a product axis, forming said tubular extension with four first portions defining said remaining body part, and four second portions defining said portions which are to be removed, mutually angularly spacing said first portions with respect to said product axis and alternating said first portions with said four second portions to be removed, and at least one second step of knitting a second section of knitting having a tubular extension, said second section being knitted substantially like said first portions.

13. Improved process according to claim 12, wherein after said second step, a third manufacturing step is performed including;

knitting two third portions as continuation of said second section of knitting, mutually angularly spacing said third portions with respect to said product axis, and -alternating said third portions with two fourth portions to be removed in order to produce a one-piece body garment.

14. Improved process according to claim 10, comprising the intermediate manufacturing steps of;

knitting a folded hem having a tubular extension, manufacturing a seciton of knitting having tubular extension extending from said folded hem and defining a product axis, manufacturing four first knitting portions as a continuation of said tubular section of knitting, whereby to form therewith said knitted body, mutually angularly spacing said first knitting portions with respect to said product axis, and alternating said four first portions with four second portions constituting said portions which are to be removed.

15. Improved process according to claim 14, wherein said folded hem is produced by adding an elastic thread.

16. Improved process according to claim 10, wherein preset regions of the product are produced by adding elastic thread.

17. Improved process according to claim 10, comprising the intermediate steps of;

forming a folded elastic hem having a tubular extension, manufacturing a section of knitting having a tubular extension, extending from said folded elastic hem and defining a product axis, manufacturing two first knitting portions as continuation of said section of knitting having a tubular extension, whereby to form therewith said knitted body, mutually angularly spacing said two first portions with respect to said product axis, alternating said two first portions with two second portions constituting said portions to be removed.

18. A process for manufacturing a semi-finished product with circular knitting machines, in particular for producing undershirts, one-piece body garments, and briefs, comprising the steps of manufacturing a knitted body defining a substantially tubular extension and having;

portions which are to be removed, and a remaining body part, the improvement comprising knitting said remaining body part throughout with a first quantity of yarns, and knitting said portions which are to be removed with a second quantity of yarns, said second quantity of yarns being less than said first quantity of yarns, wherein the steps of manufacturing a knitted body and knitting said portions which are to be removed comprise;

knitting a first section of knitting having a tubular extension defining a product axis, forming said tubular extension with a plurality of first portions defining said remaining body part, and a plurality of second portions defining said portions which are to be removed, mutually angularly spacing said first portions with respect to said product axis and alternating said first portions with said second portions to be removed, and at least one second step of knitting a second section of knitting having a tubular extension, said second section being knitted substantialy like said first portions, whereby to achieve a saving in the quantity of discarded yarn used for manufacturing the portions which are to be removed.

19. Improved process according to claim 18, wherein after said second step, a third manufacturing step is performed including;

knitting a plurality of third portions as continuation of said second section of knitting, mutually angularly spacing said third portions with respect to said product axis, and knitting a plurality of fourth portions to be removed, alternating said third portions with said fourth portions to be removed in order to produce a one-piece body garment.

20. Improved process according to claim 18, wherein said remaining part of said knitted body is knitted using at least two threads, and wherein said portions intended to be removed are knitted using a single thread, said portions to be removed each having an edge, said at least two threads used to knit said remaining part of the said knitted body being cut at said edge of each of said portions to be removed, whereby to achieve at least a 50% saving in the quantity of discarded thread used for manufacturing the portions which are to be removed.

* * * * *